US010746134B2

(12) United States Patent
Park et al.

(10) Patent No.: US 10,746,134 B2
(45) Date of Patent: Aug. 18, 2020

(54) WATER INJECTION SYSTEM AND METHOD FOR CONTROLLING THE SAME

(71) Applicants: HYUNDAI MOTOR COMPANY, Seoul (KR); KIA MOTORS CORPORATION, Seoul (KR)

(72) Inventors: Suk Il Park, Hwaseong-si (KR); Jeong Hyun Na, Hwaseong-si (KR); Young Kyung Choi, Busan (KR); Young Hwan Kim, Namyangju-si (KR); Seung Il Moon, Seoul (KR); Jong Gyun Kim, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 244 days.

(21) Appl. No.: 15/825,675

(22) Filed: Nov. 29, 2017

(65) Prior Publication Data

US 2019/0120176 A1 Apr. 25, 2019

(30) Foreign Application Priority Data

Oct. 24, 2017 (KR) ..... 10-2017-0138582

(51) Int. Cl.

| | |
|---|---|
| ***F02M 25/022*** | (2006.01) |
| ***F02M 25/028*** | (2006.01) |
| ***F02D 41/00*** | (2006.01) |
| *F02D 41/20* | (2006.01) |

(52) U.S. Cl.

CPC ..... *F02M 25/0222* (2013.01); *F02D 41/0025* (2013.01); *F02M 25/028* (2013.01); *F02M 25/0227* (2013.01); *F02D 2041/2027* (2013.01)

(58) Field of Classification Search

CPC ..... F02M 25/0222; F02M 25/0227; F02M 25/028; F02D 41/0025; F02D 2041/2027

USPC ..... 123/540

See application file for complete search history.

(56) References Cited

U.S. PATENT DOCUMENTS

| | | | | |
|---|---|---|---|---|
| 4,337,732 | A * | 7/1982 | Gerry | F02M 31/18 123/25 B |
| 2011/0098906 | A1* | 4/2011 | Barrows | F02D 41/34 701/104 |
| 2013/0167935 | A1* | 7/2013 | Lawson | F02C 7/22 137/1 |
| 2013/0238217 | A1* | 9/2013 | Nolan | F02D 19/0647 701/102 |
| 2014/0080018 | A1* | 3/2014 | Ohgami | H01M 8/045 429/415 |
| 2016/0177879 | A1* | 6/2016 | Montagne | F02M 23/14 60/779 |
| 2016/0341117 | A1* | 11/2016 | Ekstrom | F02M 25/03 |
| 2017/0107080 | A1* | 4/2017 | Steinhauer | B66B 1/36 |

* cited by examiner

*Primary Examiner* — Joseph J Dallo
*Assistant Examiner* — Yi-Kai Wang
(74) *Attorney, Agent, or Firm* — Morgan, Lewis & Bockius LLP

(57) ABSTRACT

A water injection system for spraying water toward an intake system of an engine is disclosed. The water injection system includes a water collection circuit that has a water collection pipe for collecting water from the intake system and a drain valve installed on the water collection pipe. The water collection circuit collects water from the intake system of the engine by opening the drain valve when amount of stagnant water in the intake system reaches a predetermined threshold.

15 Claims, 9 Drawing Sheets

WATER INJECTION SYSTEM AND METHOD FOR CONTROLLING THE SAME

CROSS-REFERENCE TO RELATED APPLICATION

This application is based on and claims the benefit of priority to Korean Patent Application No. 10-2017-0138582, filed on Oct. 24, 2017, in the Korean Intellectual Property Office, the disclosure of which is incorporated herein in its entirety by reference.

FIELD

The present disclosure relates to a water injection system for injecting water toward an intake port by using a water injector. More specifically, the present disclosure relates to a water injection system and a control method thereof for collecting stagnant water from an intake pipe or manifold into a water tank to prevent water from flowing into an engine.

BACKGROUND

A variety of technologies have been studied and developed to suppress emissions (e.g., nitrogen oxide, hydrocarbon, and the like) by reducing heat of combustion in an internal combustion engine of a vehicle and to improve fuel efficiency by decreasing a mixture ratio between air and fuel.

Exhaust gas recirculation (EGR) systems, water injection systems, or the like have been studied and developed as a representative technology for reducing heat of combustion and nitrogen oxide and improving fuel efficiency.

A water injection system may inject water toward intake air or a fuel-air mixture or may directly inject water toward an intake port of an engine to lower the temperature of the engine, thereby reducing knocking and suppressing emissions, and may decrease a mixture ratio between air and fuel to increase engine power and torque.

However, if a flow rate decreases or droplets become larger in a specific part on account of flow characteristics in an intake pipe or manifold when a water injector injects water toward the intake port of the engine, insufficiently-gasified droplets may stagnate in the intake pipe or manifold, and the stagnant water may flow into the engine under a specific condition to cause an engine stall.

Furthermore, since the water injection system in the related art has to inject water more than 30% of average daily fuel consumption, a high-capacity water tank is required to store water, and therefore an installation space for an engine room may be limited.

The disclosure of this section is to provide background of the invention. Applicant notes that this section may contain information available before this application. However, by providing this section, Applicant does not admit that any information contained in this section constitutes prior art.

SUMMARY

The present disclosure has been made to solve the above-mentioned problems occurring in the related art while advantages achieved by the related art are maintained intact.

An aspect of the present disclosure provides a water injection system and a control method thereof for collecting stagnant water from an intake pipe or manifold of an intake system into a water tank to prevent water from flowing into an engine.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a water injection system includes a water injector that injects water toward an intake system of an engine, a water supply circuit that has a water supply pipe, a water tank installed at an upstream end of the water supply pipe, a shut-off valve disposed downstream of the water tank, and an injection valve disposed downstream of the shut-off valve, a purge circuit that has an air supply pipe, an air tank installed at an upstream end of the air supply pipe, and a purge valve disposed downstream of the air tank, a water collection circuit that has a water collection pipe connecting the intake system of the engine and the water tank to collect the water from the intake system of the engine into the water tank and a drain valve installed on the water collection pipe so as to be openable and closable, and an electronic or engine control unit (ECU) that controls the water supply circuit, the purge circuit, and the water collection circuit. The water collection circuit collects water from the intake system of the engine by opening the drain valve if an amount of stagnant water in the intake system of the engine reaches a predetermined threshold.

The shut-off valve may be continuously open for a water injection duration time.

The injection valve may operate in accordance with a PWM (Pulse Width Modulation) duty cycle.

The ECU may individually control the shut-off valve and the injection valve at a predetermined time interval to fill the water supply pipe with water and then allow the water injector to inject the water.

The purge valve may operate in accordance with a PWM duty cycle.

According to another aspect of the present disclosure, provided is a method of controlling a water injection system that includes a water injector that injects water toward an intake system of an engine, a water supply circuit, a purge circuit, a water collection circuit, and an electronic control unit (ECU) that controls the water supply circuit, the purge circuit, and the water collection circuit, wherein the water supply circuit has a water supply pipe, a water tank installed at an upstream end of the water supply pipe, a shut-off valve disposed downstream of the water tank, and an injection valve disposed downstream of the shut-off valve, the purge circuit has an air supply pipe, an air tank installed at an upstream end of the air supply pipe, and a purge valve disposed downstream of the air tank, and the water collection circuit has a water collection pipe connecting the intake system of the engine and the water tank to collect the water from the intake system of the engine into the water tank and a drain valve installed on the water collection pipe so as to be openable and closable. The method includes a water injection step of injecting, by the water injector, water supplied from the water tank toward the intake system of the engine for a predetermined water injection duration time, an purge step of purging the water injector with air for a predetermined purge time after the water injection duration time, and a water collecting step of collecting water in the water tank by opening the drain valve for a predetermined period of time if an amount of stagnant water in the intake system of the engine reaches a predetermined threshold.

The shut-off valve may be continuously open for the water injection duration time in the water injection step.

The water injection step may include a primary water filling step of filling the water supply pipe with water flowing out of the water tank to an inlet of the injection valve by opening the shut-off valve and closing the injection valve for a first predetermined water filling time.

The water injection step may further include a secondary water filling step of filling the water supply pipe with the water flowing out of the water tank to the water injector by opening the injection valve for a second predetermined water filling time after the first water filling time.

In the water injection step, the injection valve may be controlled in accordance with a predetermined PWM duty cycle after the secondary water filling step so as to be repeatedly opened and closed for a predetermined period of time.

The purge step may include a primary purge step of closing the shut-off valve and the injection valve after the water injection step and repeatedly opening and closing the purge valve for a first predetermined purge time by controlling the purge valve in accordance with a first predetermined PWM duty cycle.

The purge step may further include a secondary purge step performed by controlling the purge valve in accordance with a second predetermined PWM duty cycle after the first purge time.

The second PWM duty cycle may be set to be greater than the first PWM duty cycle.

The second purge time may be set to be longer than the first purge time.

An amount of stagnant water in the intake system may be computed by using an amount of water leaking from the water injector in the water filling step, an amount of water stagnating in the intake system without being atomized when the water injector injects water, and an amount of water discharged from the water supply pipe for the first purge time.

According to embodiments of the present disclosure, by collecting stagnant water from an intake pipe or manifold of an intake system into a water tank, it is possible to prevent water from flowing into cylinders of an engine.

According to embodiments of the present disclosure, by filling a water supply pipe with water in stages through primary and secondary water filling steps before a water injector injects water, it is possible to more efficiently and accurately inject water.

According to embodiments of the present disclosure, by opening and closing an injection valve in accordance with a predetermined duty cycle, it is possible to very stably atomize water, thereby preventing occurrence of droplets or minimizing the size of droplets.

According to embodiments of the present disclosure, by sequentially purging the water supply pipe and the water injector through primary and secondary purge steps, it is possible to prevent water from stagnating in the water supply pipe and the water injector.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
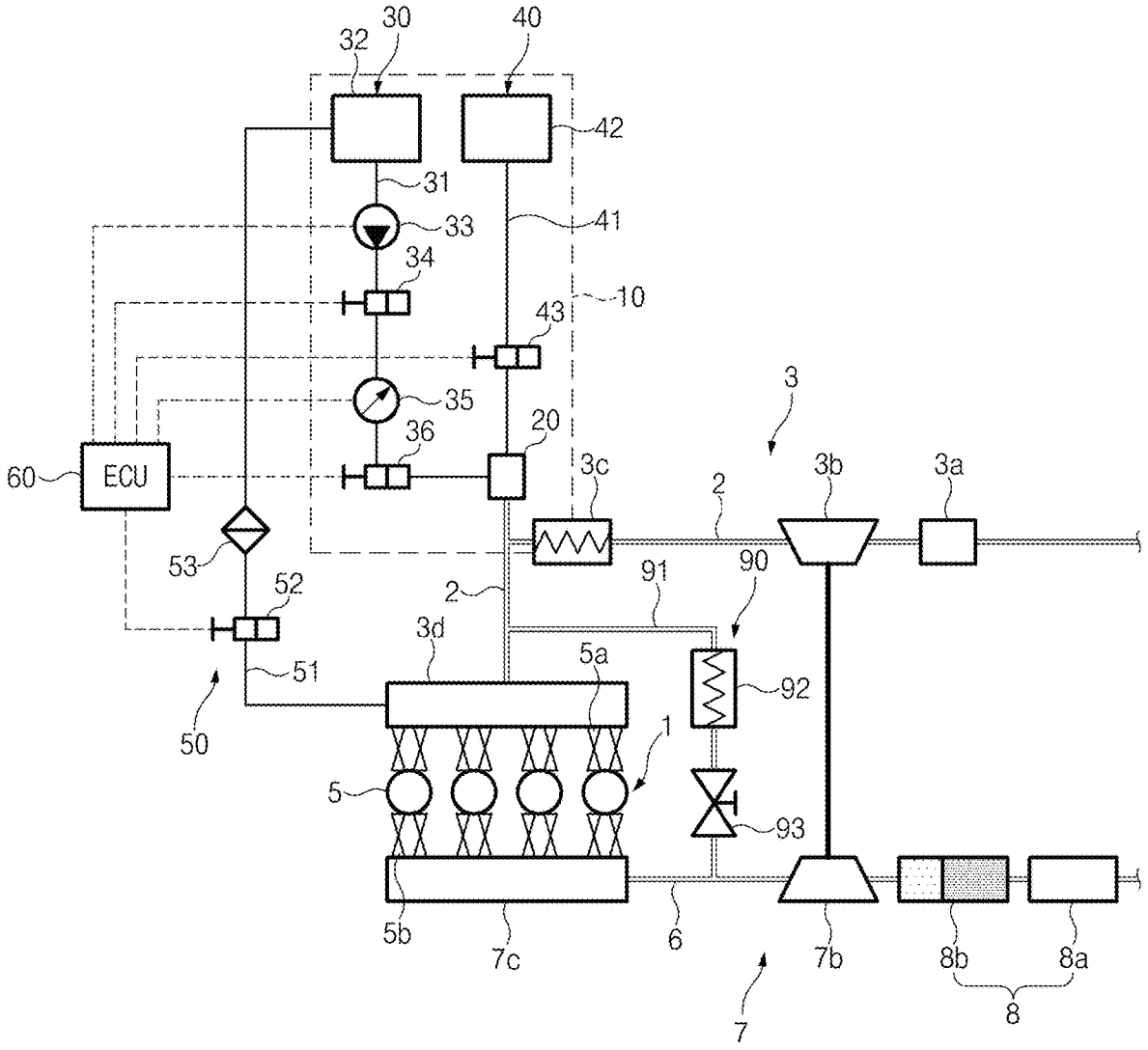
FIG. 1 is a diagram illustrating a water injection system according to an embodiment of the present disclosure.

Hereinafter, embodiments of the present disclosure will be described in detail with reference to the accompanying drawings. In the drawings, the same reference numbers will be used throughout to designate the same or equivalent elements. In addition, a detailed description of well-known features or functions will be ruled out in order not to unnecessarily obscure the gist of the present disclosure.

Terms, such as "first", "second", "A", "B", "(a)", "(b)", and the like, may be used herein to describe elements of the present disclosure. Such terms are only used to distinguish one element from another element, and the substance, sequence, order, or number of these elements is not limited by these terms. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

An aspect of the present invention provides a water spraying system for spraying water into an intake system of a combustion engine. The water spraying system comprise a nozzle for spraying particulate water into an air intake of the engine. The water spraying system has a water drain circuit 50 connected to the intake system 3*d* to remove water remaining inside the intake system (intake manifold). The water spraying system opens a water drain valve 52 of the water drain circuit 50 when an estimated amount of water remaining in the intake system is greater than a predetermined reference. In embodiments, an inlet to the water collection pipe 51 is connected at a bottom portion of the intake manifold 3*d* such that water drops inside the intake manifold are collected to the inlet by gravity.

In embodiments, a computing device of the water spraying system (ECU 60) estimates (1) amount of water leaked from the nozzle 20 to intake system 3*d* during a water filling process (S1-1, S1-2), (2) amount of water that has not been sprayed as particulate water during the spraying process (S1-3) and remaining inside intake pipe 2 or the intake system 3*d* and (3) amount of water discharge by an purge (S2-1, S2-2). In embodiments, to estimate these amounts, computing device uses information collected about operation of a water supply circuit 30 (opening duration, duty of valves 34/36, pressure measured using the pressure sensor 35), and/or information collected about operation of an purge system 40 (opening duration, duty purge valve 43).

In embodiments, using at least one of the estimated amounts, the computing device estimates amount of water remaining in the intake manifold and determines whether to open the water drain valve accordingly.

Referring to FIG. 1, a water injection system 10 according to an embodiment of the present disclosure may include a water injector 20 for injecting water toward an intake system 3 of an engine 1, a water supply circuit 30 for supplying water to the water injector 20, a purge circuit 40 for purging the water injector 20, a water collection circuit 50 for collecting water from the intake system 3 of the engine 1, and an electronic control unit (ECU) 60.

The water injection system 10 according to an embodiment of the present disclosure may be connected to the intake system 3 of the vehicle engine 1 to inject water toward the intake system 3, and the engine 1 may be a multi-cylinder internal combustion engine having a plurality of cylinders 5.

The intake system 3 of the engine 1 may have an air filter 3*a* installed adjacent to an inlet of an intake pipe 2, a compressor 3*b* installed downstream of the air filter 3*a*, an intercooler 3*c* installed downstream of the compressor 3*b*, an intake manifold 3*d* communicating with intake ports 5*a* of the respective cylinders 5, and the like.

An exhaust system 7 of the engine 1 may have an after-treatment device 8 installed along an exhaust pipe 6, a turbine 7*b* installed upstream of the after-treatment device 8, an exhaust manifold 7*c* communicating with exhaust ports 5*b* of the respective cylinders 5, and the like. The after-treatment device 8 may be implemented by various combinations of a DOC 8*a*, a DOC and DPF integrated structure 8*b*, an SCR, and the like.

An exhaust gas recirculation (EGR) circuit 90 may be installed between the exhaust pipe 6 and the intake pipe 2. The EGR circuit 90 may include an EGR pipe 91 connected between the exhaust pipe 6 and the intake pipe 2, an EGR cooler 92 installed on the EGR pipe 91, and an EGR valve 93 installed upstream of the EGR cooler 92.

As illustrated in FIG. 1, the EGR pipe 91 may be disposed upstream of the turbine 7*b*, and therefore the EGR circuit 90 may be a high-pressure EGR circuit. Without being limited thereto, however, the EGR pipe 91 of the EGR circuit 90 may be installed downstream of the after-treatment device 8, and therefore the EGR circuit 90 may be a low-pressure EGR circuit.

The water injector 20 may be installed on a side of the intake system 3 to inject water toward intake air flowing into the intake system 3 of the engine 1 or the intake manifold 3*d* of the engine 1.

According to an embodiment, the water injector 20 may be mounted on the intake pipe 2. The water injector 20 may be disposed between an outlet of the intercooler 3*c* and the intake ports 5*a* of the respective cylinders 5. Accordingly, the water injector 20 may inject water toward the intake ports 5*a* of the respective cylinders 5.

According to another embodiment, the water injector 20 may be mounted on the intake manifold 3*d*. Accordingly, the water injector 20 may inject water toward the intake ports 5*a* of the respective cylinders 5.

The water supply circuit 30 may include a water supply pipe 31, a water tank 32 installed at an upstream end of the water supply pipe 31, a water pump 33 for pumping water in the water tank 32 toward the water injector 20, a shut-off valve 34 disposed downstream of the water pump 33, and an injection valve 36 disposed downstream of the shut-off valve 34.

The shut-off valve 34 may be configured to open or close the flow passage in the water supply pipe 31 to supply or block water. The shut-off valve 34 may serve as a safety valve in case of a failure, a leak, and the like in the injection valve 36. The shut-off valve 34 may be opened in response to a water injection signal received from the ECU 60. The shut-off valve 34 may be continuously open for the duration of water injection.

A pressure sensor 35 may be disposed between the shut-off valve 34 and the injection valve 36 to sense pressure in the water supply pipe 31.

The injection valve 36 may be configured to operate in accordance with a PWM duty cycle. Accordingly, the injection valve 36 may adjust a water injection rate, an amount of water to be injected, or the like in accordance with the PWM duty cycle, the duration of water injection, or the like. The injection valve 36 may be implemented with an electronic control valve, such as a solenoid valve.

The purge circuit 40 may include an air supply pipe 41, an air tank 42 installed at an upstream end of the air supply pipe 41, and a purge valve 43 disposed downstream of the air tank 42.

The purge valve 43 may be configured to operate in accordance with a PWM duty cycle. Accordingly, the purge valve 43 may adjust an purge rate, an amount of purge air, or the like. The purge valve 43 may be implemented with an electronic control valve, such as a solenoid valve.

The water collection circuit 50 may be configured to collect water from the intake system 3 of the engine 1 into the water tank 32.

According to an embodiment, the water collection circuit 50 may include a water collection pipe 51 connecting the intake system 3 of the engine 1 and the water tank 32, a drain valve 52 installed on the water collection pipe 51, and a filter 53 disposed between the drain valve 52 and the water tank 32.

An inlet of the water collection pipe 51 may be coupled to the intake manifold 3*d*, and an outlet of the water collection pipe 51 may be coupled to the water tank 32.

The drain valve 52 may be disposed at a lower position than the intake pipe 2 or the intake manifold 3*d*. If the drain valve 52 is opened, stagnant water in the intake pipe 2 or the intake manifold 3*d* of the intake system 3 may be effectively collected in the water tank 32 through the water collection pipe 51.

The drain valve 52 may be implemented with a calibratable valve, the opening degree of which is varied depending on the specifications of the intake manifold 3*d*, the specifications of the engine 1, and the like.

A collection pump (not illustrated) may be installed between the drain valve 52 and the water tank 32, and water collection efficiency may be enhanced by the collection pump.

The drain valve 52 may be configured to be opened if the amount of stagnant water in the intake pipe 2 or the intake manifold 3*d* of the intake system 3 reaches a predetermined threshold, and therefore the stagnant water in the intake system 3 may be collected in the water tank 32.

The ECU 60 may be a known control unit sometimes referred to as an electronic or engine control module(ECM), engine control unit(ECU) or the like.

The water pump 33, the shut-off valve 34, the pressure sensor 35, and the injection valve 36 of the water supply circuit 30 may be electrically connected to the ECU 60. The ECU 60 may detect pressure of water supplied through the water supply pipe 31 by using the pressure sensor 35. The ECU 60 may control operations of the water pump 33, the shut-off valve 34, and the injection valve 36.

According to an embodiment, the ECU 60 may be configured to individually control the shut-off valve 34 and the injection valve 36 at a predetermined time interval to fill the water supply pipe 31 with water and then allow the water injector 20 to inject the water.

The purge valve 43 of the purge circuit 40 may be electrically connected to the ECU 60. The ECU 60 may control operations of the purge valve 43.

The drain valve 52 of the water collection circuit 50 may be electrically connected to the ECU 60. The ECU 60 may control operations of the drain valve 52. Particularly, if the amount of stagnant water in the intake manifold 3*d* reaches a predetermined threshold, the ECU 60 may open the drain valve 52 for a predetermined period of time before the amount of stagnant water exceeds the predetermined threshold. If the amount of stagnant water exceeds the predetermined threshold, the water may flow into the cylinders 5 of the engine 1.

The predetermined threshold may be determined through a test by using information, such as the number of times water is to be injected, an amount of water to be injected, and the like. The predetermined threshold may be varied depending on the specifications of the intake manifold 3*d*, the specifications of the engine 1, or the like.

FIGS. 2 to 9 illustrate a method of controlling the water injection system, according to an embodiment of the present disclosure.

If the ECU 60 sends a water injection signal to the shut-off valve 34 and the injection valve 36, water may be supplied to the water injector 20 by the water supply circuit 30, and the water injector 20 may inject the water toward the intake system 3 for a predetermined injection duration time (see A in FIG. 2) (Step S1).

The water injection step S1 will be described below in more detail.

Figure 2:
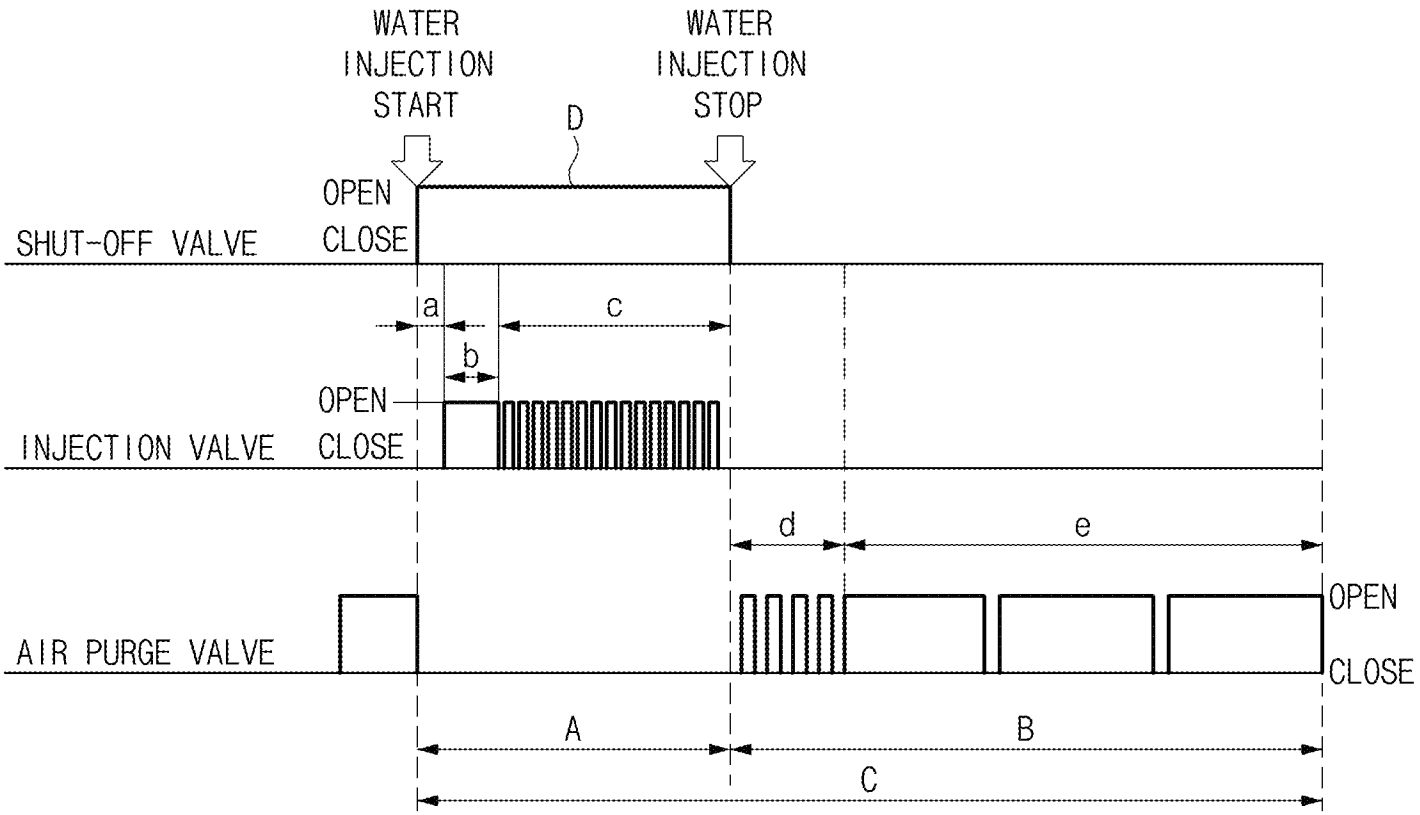
FIG. 2 is a graph illustrating a water injection process and an purge process of the water injection system, according to an embodiment of the present disclosure.
Figure 3:
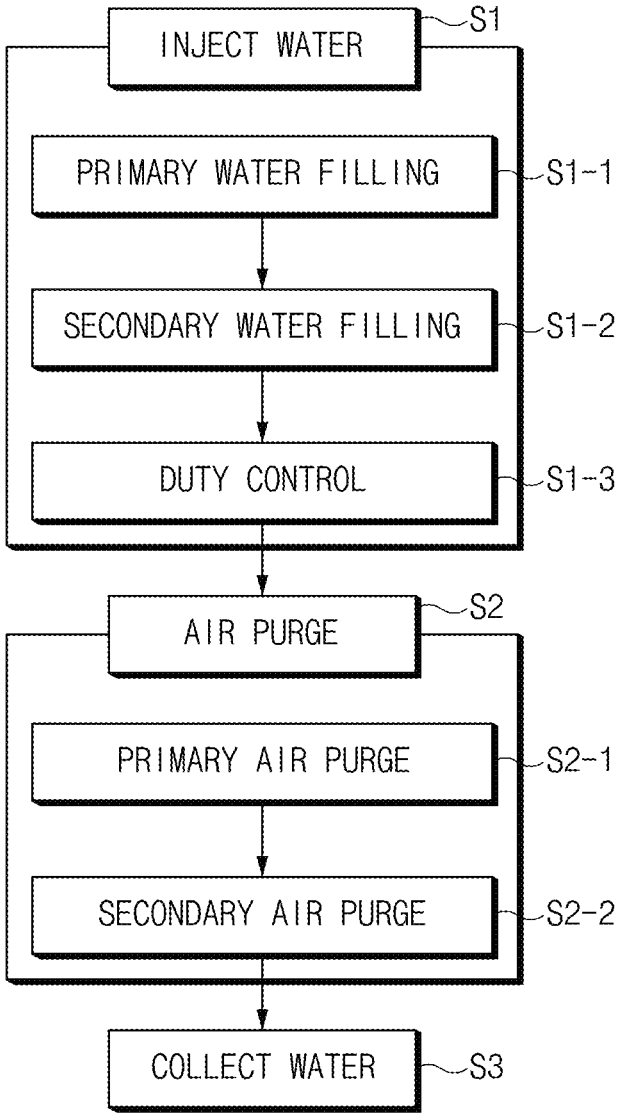
FIG. 3 is a flowchart illustrating a method of controlling the water injection system, according to an embodiment of the present disclosure.

The shut-off valve 34 may be continuously open for the injection duration time "A" (see line D in FIG. 2). If the water pump 33 operates in the state in which the shut-off valve 34 is open, water may flow out of the water tank 32, and the water supply pipe 31 may be filled with the water. Hereinafter, the step of filling the water supply pipe 31 with water may be referred to as a water filling step. The water filling step may include a primary water filling step S1-1 and a secondary water filling step S1-2, which are performed in a serial order.

Figure 4:
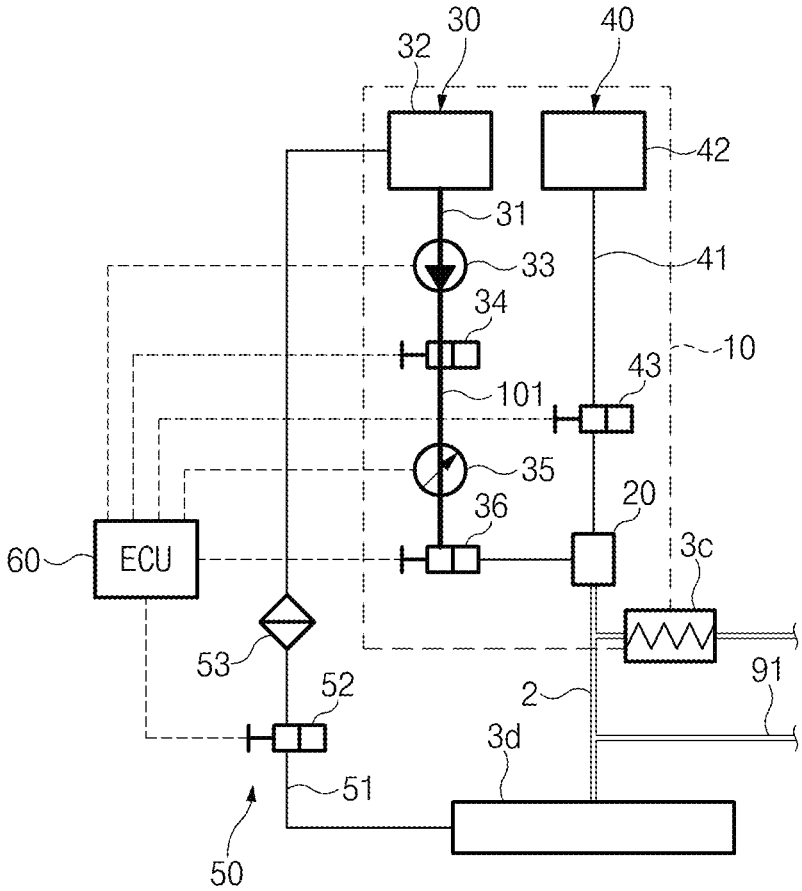
FIG. 4 illustrates a primary water filling step of the water injection system, according to an embodiment of the present disclosure.

The primary water filling step S1-1, in which the shut-off valve 34 is open and the injection valve 36 is closed, may be performed. As illustrated in FIG. 4, the injection valve 36 may be closed for a first water filling time (see "a" in FIG. 2), and therefore the water supply pipe 31 may be filled with water flowing out of the water tank 32 to an inlet of the injection valve 36 (see reference number "101" in FIG. 4). In this case, the pressure sensor 35 may measure supply pressure of the water with which the water supply pipe 31 is filled, and the ECU 60 may compute the first water filling time "a" by using the supply pressure of the water, the internal volume of the water supply pipe 31, and the like.

Figure 5:
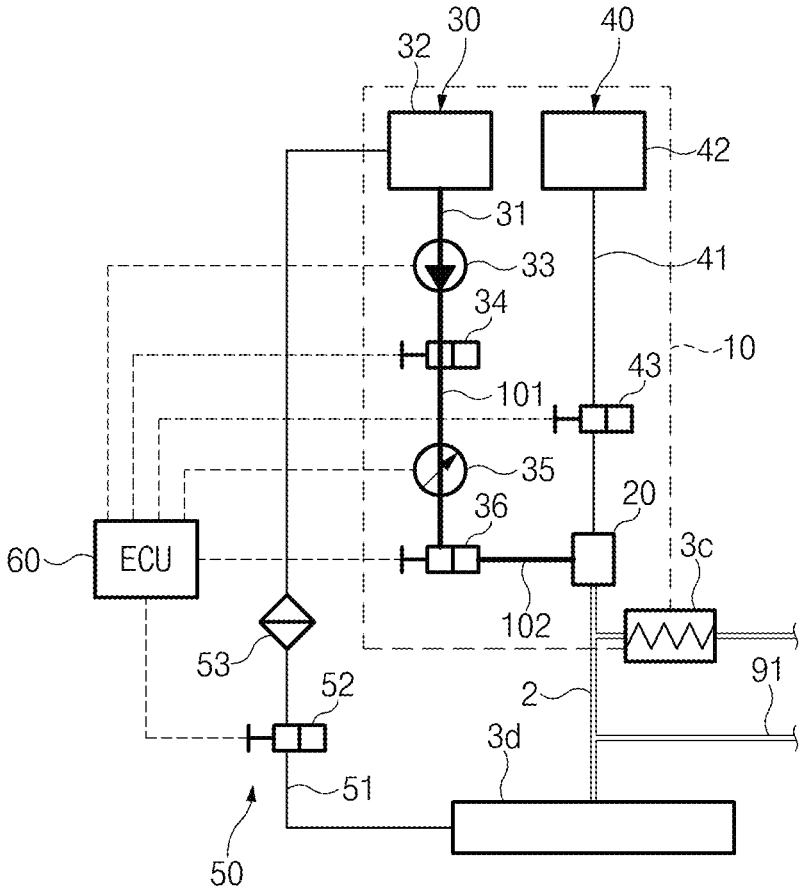
FIG. 5 illustrates a secondary water filling step of the water injection system, according to an embodiment of the present disclosure.

The secondary water filling step S1-2, in which the shut-off valve 34 and the injection valve 36 are open together, may be performed after the primary water filling step S1-1. As illustrated in FIG. 5, the injection valve 36 may be open for a second water filling time (see "b" in FIG. 2) after the first water filling time "a", and therefore the water supply pipe 31 may be filled with water flowing out of the water tank 32 to the water injector 20 (see reference number "102" in FIG. 5). In this case, the ECU 60 may compute the second water filling time "b" by using the supply pressure of the water, the internal volume of the water supply pipe 31, and the like. Furthermore, the ECU 60 may compute the amount of water with which the water supply pipe 31 is filled in the secondary water filling step, by using the second water filling time "b" and the internal volume of the water supply pipe 31 into which the water is supplied in the secondary water filling step, and may compute the amount of water leaking from the water injector 20 into the intake pipe 2 or the intake manifold 3*d*, by subtracting the amount of water with which the water supply pipe 31 is filled in the secondary water filling step from the amount of water supplied from the water tank 32.

As described above, by filling the water supply pipe 31 with water in stages through the water filling steps S1-1 and S1-2 before the water injector 20 injects the water, it is possible to more efficiently and accurately inject the water.

Figure 6:
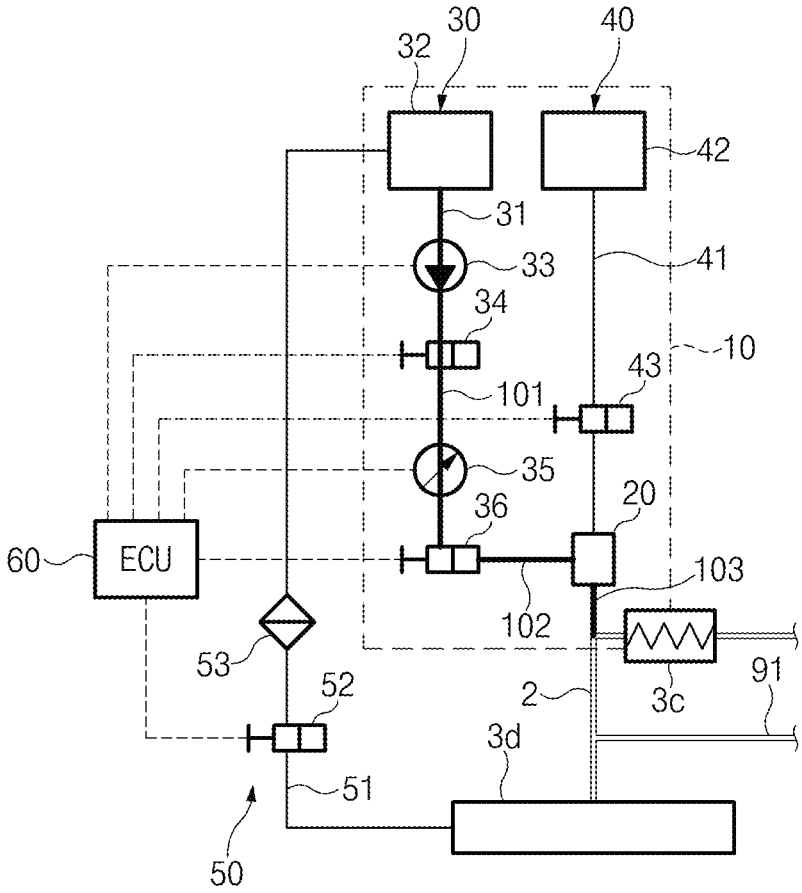
FIG. 6 illustrates a duty control step of the water injection system, according to an embodiment of the present disclosure.

After the secondary water filling step S1-2, as illustrated in FIG. 6, the ECU 60 may control the injection valve 36 in accordance with a predetermined PWM duty cycle to repeatedly open and close the injection valve 36 for a predetermined period of time (see "c" in FIG. 2) (Step S1-3). Through the duty control of the injection valve 36, a predetermined amount of water may be injected through the water injector 20 (see reference number "103" in FIG. 6).

As described above, by opening and closing the injection valve 36 in accordance with the predetermined PWM duty cycle (Step S1-3), it is possible to very stably atomize water, thereby preventing occurrence of droplets or minimizing the size of droplets.

After the predetermined water injection duration time A, the ECU 60 may close the shut-off valve 34 and the injection valve 36 and may perform an purge step for a predetermined purge time (see "B" in FIG. 2) (Step S2).

The purge step S2 will be described below in more detail.

Figure 7:
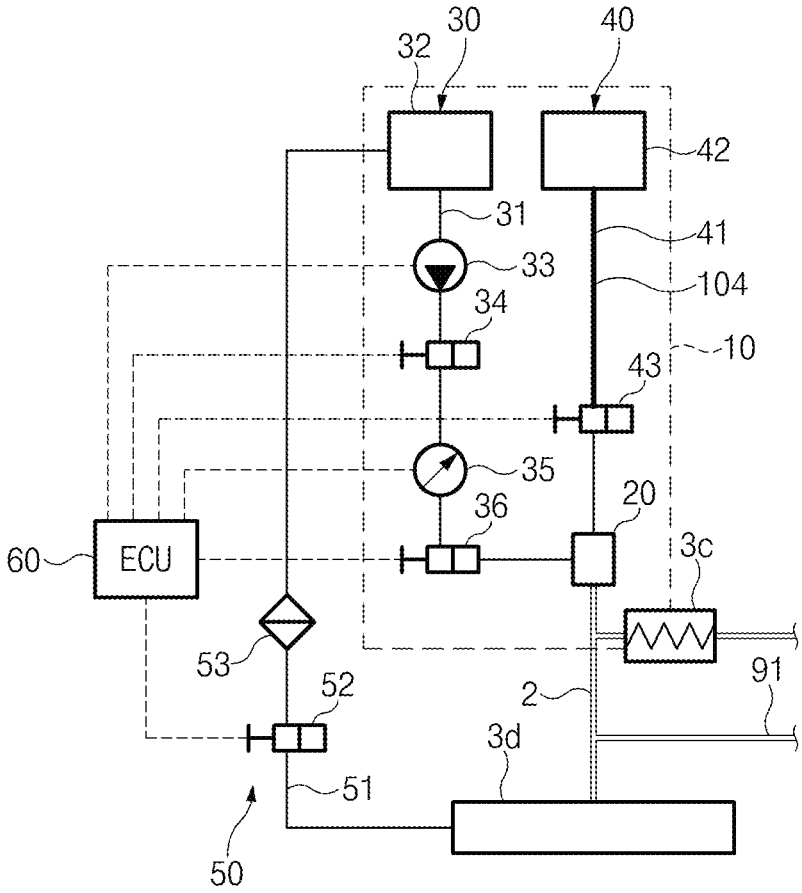
FIG. 7 illustrates a state prior to a primary purge step of the water injection system, according to an embodiment of the present disclosure.

As illustrated in FIG. 7, the purge valve 43 may be closed for the predetermined water injection duration time A (see reference number "104" in FIG. 7), and a primary purge step S2-1 (see FIG. 8) may be performed for a first purge time (see "d" in FIG. 2) by operating the purge valve 43 after the water injection step S1.

Figure 8:
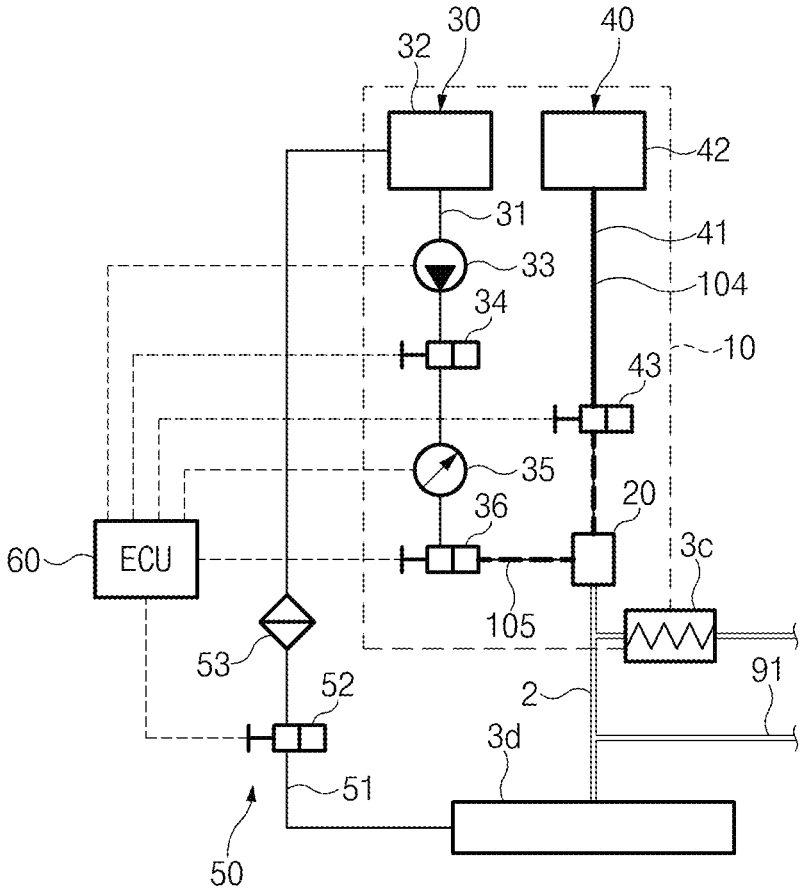
FIG. 8 illustrates the primary purge step of the water injection system, according to an embodiment of the present disclosure.

The ECU 60 may control the purge valve 43 in accordance with a first predetermined PWM duty cycle to repeatedly open and close the purge valve 43 for the first predetermined purge time "d" (Step S2-1). Accordingly, as illustrated in FIG. 8, air may be supplied into the water injector 20 and the water supply pipe 31 connected to the water injector 20 from the air tank 42 via the air supply pipe 41, and therefore water remaining in the water supply pipe 31 communicating with the water injector 20 may be discharged by the purge (see reference number "105" in FIG. 8).

After the primary purge step S2-1, a secondary purge step S2-2 may be performed for a second predetermined purge time (see "e" in FIG. 2).

The ECU 60 may control the purge valve 43 in accordance with a second predetermined PWM duty cycle to perform the secondary purge step. Here, the second PWM duty cycle in the secondary purge step may be greater than the first PWM duty cycle in the primary purge step. For example, the second PWM duty cycle may be 90%, and the first PWM duty cycle may be 50%.

Furthermore, the second purge time "e" may be longer than the first purge time "d".

Figure 9:
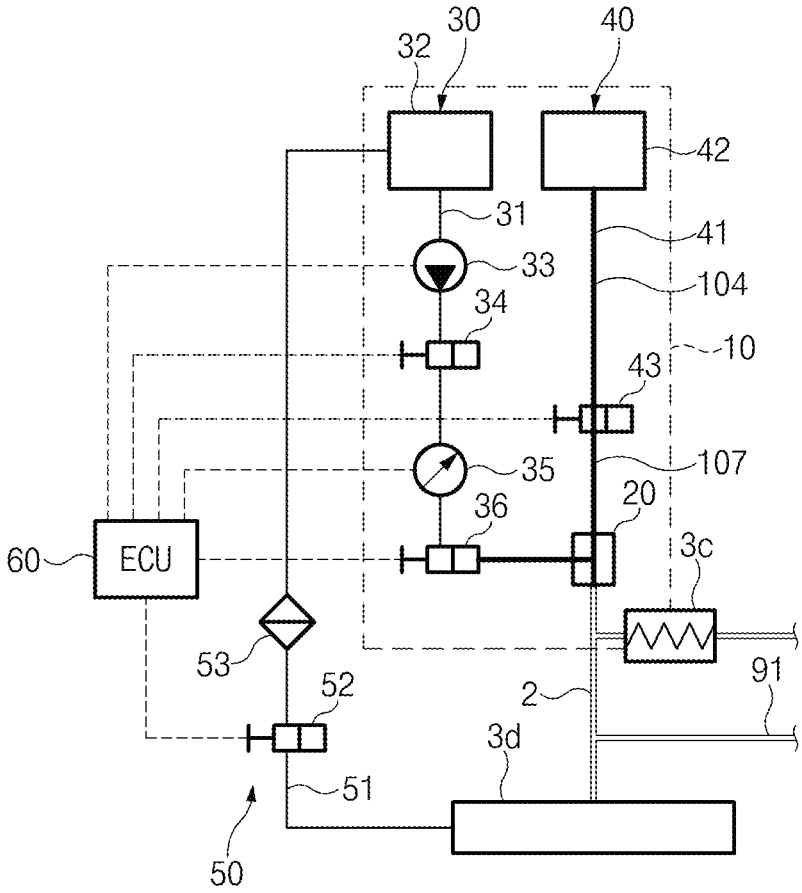
FIG. 9 illustrates a secondary purge step of the water injection system, according to an embodiment of the present disclosure.

Through the secondary purge step S2-2, air may be supplied into the water injector 20 from the air tank 42 via the air supply pipe 41, as illustrated in FIG. 9, and therefore it is possible to prevent clogging of a nozzle in the water injector 20, which is caused by backflow of an EGR gas (see reference number "107" in FIG. 9).

As described above, by sequentially purging the water supply pipe 31 and the water injector 20 through the primary purge step S2-1 and the secondary purge step S2-2, it is possible to prevent water from stagnating in the water supply pipe 31 and the water injector 20.

After the purge step S2, the ECU 60 may compute the amount of stagnant water in the intake manifold 3*d*. If the amount of stagnant water reaches a predetermined threshold, the ECU 60 may open the drain valve 52 for a predetermined period of time to collect the stagnant water from the intake manifold 3*d* into the water tank 32 through the water collection pipe 51 (Step S3).

The ECU 60 may compute (predict) the amount of stagnant water by using the amount of water leaking from the water injector 20 in the water filling step (particularly, the secondary water filling step S1-2), the amount of water stagnating in the intake pipe 2 or the intake manifold 3*d* without being atomized when the water injector 20 injects water in the duty control step S1-3, and the amount of water discharged from the water supply pipe 31 in the primary purge step S2-1.

The ECU 60 may compute the amount of water with which the water supply pipe 31 is filled in the secondary water filling step, by using the second water filling time "b" and the internal volume of the water supply pipe 31 into which the water is supplied in the secondary water filling step, and may compute the amount of water leaking from the water injector 20 into the intake pipe 2 or the intake manifold 3*d*, by subtracting the amount of water with which the water supply pipe 31 is filled in the secondary water filling step from the amount of water supplied from the water tank 32.

When water is injected from the water injector 20 in the duty control step S1-3, the water may flow into the cylinders without being atomized to 100% and some of the water may stagnate in the intake pipe 2 or the intake manifold 3*d* on account of flow characteristics and wall wetting in a flow-rate reduction section. Accordingly, the ECU 60 may compute the amount of water stagnating in the duty control step S1-3 through a test according to injection quantity, injection pressure, and injection time.

The ECU 60 may compute the amount of water discharged by the purge in the primary purge step S2-1, by using the first PWM duty cycle of the first purge time "d" and the internal volume of the water supply pipe 31.

Logical blocks, modules or units described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Although the present disclosure has been described with reference to embodiments and the accompanying drawings, the present disclosure is not limited thereto, but may be variously modified and altered by those skilled in the art to which the present disclosure pertains without departing from the spirit and scope of the present disclosure.

Embodiments of the present disclosure are provided to explain features, spirit and scope of the present invention. But, the present invention is not limited by the embodiments. Technical ideas, features of the original claims are included in scope of the present disclosure.

What is claimed is:

1. A water injection system comprising:

a water injector configured to inject water toward an intake system of an engine;

a water supply circuit that has a water supply pipe, a water tank installed at an upstream end of the water supply pipe, a shut-off valve disposed downstream of the water tank, and an injection valve disposed downstream of the shut-off valve;

a purge circuit that has an air supply pipe, an air tank installed at an upstream end of the air supply pipe, and a purge valve disposed downstream of the air tank;

a water collection circuit that has a water collection pipe connecting the intake system of the engine and the water tank to collect the water from the intake system of the engine into the water tank and a drain valve installed on the water collection pipe so as to be openable and closable; and an electronic control unit (ECU) configured to control the water supply circuit, the purge circuit, and the water collection circuit, wherein the water collection circuit is configured to collect water from the intake system of the engine by opening the drain valve if an amount of stagnant water in the intake system of the engine reaches a predetermined threshold, wherein the injection valve is disposed between the shut-off valve and the water injector, and wherein an inlet of the water collection pipe is directly connected to an intake manifold of the intake system and an outlet of the water collection pipe is directly connected to the water tank.

2. The water injection system of claim 1, wherein the shut-off valve is configured to be continuously open for a water injection duration time.

3. The water injection system of claim 1, wherein the injection valve operates in accordance with a PWM duty cycle.

4. The water injection system of claim 1, wherein the ECU is configured to individually control the shut-off valve and the injection valve at a predetermined time interval to fill the water supply pipe with water and then allow the water injector to inject the water.

5. The water injection system of claim 1, wherein the purge valve operates in accordance with a PWM duty cycle.

6. A method of controlling a water injection system that includes a water injector configured to inject water toward an intake system of an engine, a water supply circuit, a purge circuit, a water collection circuit, and an electronic control unit (ECU) configured to control the water supply circuit, the purge circuit, and the water collection circuit, wherein the water supply circuit has a water supply pipe, a water tank installed at an upstream end of the water supply pipe, a shut-off valve disposed downstream of the water tank, and an injection valve disposed downstream of the shut-off valve, the purge circuit has an air supply pipe, an air tank installed at an upstream end of the air supply pipe, and a purge valve disposed downstream of the air tank, and the water collection circuit has a water collection pipe connecting the intake system of the engine and the water tank to collect the water from the intake system of the engine into the water tank and a drain valve installed on the water collection pipe so as to be openable and closable, the method comprising:

a water injection step of injecting, by the water injector, water supplied from the water tank toward the intake system of the engine for a predetermined water injection duration time;

an purge step of purging the water injector with air for a predetermined purge time after the water injection duration time; and a water collecting step of collecting water in the water tank by opening the drain valve for a predetermined period of time if an amount of stagnant water in the intake system of the engine reaches a predetermined threshold, wherein the injection valve is disposed between the shut-off valve and the water injector; and wherein an inlet of the water collection pipe is directly connected to an intake manifold of the intake system and an outlet of the water collection pipe is directly connected to the water tank.

7. The method of claim 6, wherein the shut-off valve is continuously open for the water injection duration time in the water injection step.

8. The method of claim 7, wherein the water injection step includes:

a primary water filling step of filling the water supply pipe with water flowing out of the water tank to an inlet of the injection valve by opening the shut-off valve and closing the injection valve for a first predetermined water filling time.

9. The method of claim 8, wherein the water injection step further includes:

a secondary water filling step of filling the water supply pipe with the water flowing out of the water tank to the water injector by opening the injection valve for a second predetermined water filling time after the first water filling time.

10. The method of claim 9, wherein in the water injection step, the injection valve is controlled in accordance with a predetermined PWM duty cycle after the secondary water filling step so as to be repeatedly opened and closed for a predetermined period of time.

11. The method of claim 6, wherein the purge step includes:

a primary purge step of closing the shut-off valve and the injection valve after the water injection step and repeatedly opening and closing the purge valve for a first predetermined purge time by controlling the purge valve in accordance with a first predetermined PWM duty cycle.

12. The method of claim 11, wherein the purge step further includes:

a secondary purge step performed by controlling the purge valve in accordance with a second predetermined PWM duty cycle after the first purge time.

13. The method of claim 12, wherein the second PWM duty cycle is set to be greater than the first PWM duty cycle.

14. The method of claim 12, wherein the second purge time is set to be longer than the first purge time.

15. The method of claim 6, wherein an amount of stagnant water in the intake system is computed by using an amount of water leaking from the water injector in the water filling step, an amount of water stagnating in the intake system without being atomized when the water injector injects water, and an amount of water discharged from the water supply pipe for the first purge time.

* * * * *